US009573145B2

(12) United States Patent
Kah, Jr.

(10) Patent No.: US 9,573,145 B2
(45) Date of Patent: Feb. 21, 2017

(54) PRESSURE REGULATING NOZZLE ASSEMBLY

(76) Inventor: Carl L. C. Kah, Jr., North Palm Beach, FL (US)

( * ) Notice: Subject to any disclaimer, the term of this patent is extended or adjusted under 35 U.S.C. 154(b) by 21 days.

(21) Appl. No.: 11/438,796

(22) Filed: May 22, 2006

(65) Prior Publication Data

US 2006/0278727 A1 Dec. 14, 2006

Related U.S. Application Data

(60) Provisional application No. 60/683,548, filed on May 20, 2005.

(51) Int. Cl.

| | |
|---|---|
| ***B05B 15/10*** | (2006.01) |
| ***B05B 1/34*** | (2006.01) |
| ***B05B 1/14*** | (2006.01) |
| ***B05B 1/30*** | (2006.01) |
| *B05B 1/26* | (2006.01) |

(52) U.S. Cl.

CPC ..... *B05B 1/3006* (2013.01); *B05B 1/262* (2013.01); *B05B 1/304* (2013.01); *B05B 15/10* (2013.01)

(58) Field of Classification Search

CPC ..... B05B 1/3006; B05B 1/262; B05B 15/10; B05B 1/304

USPC ..... 239/204, 205, 203, 201, 200, 469, 470,239/471, 473, 569, 590, 590.3, 553, 553.3, 575; 138/26, 37

See application file for complete search history.

(56) References Cited

U.S. PATENT DOCUMENTS

| | | | | | |
|---|---|---|---|---|---|
| 3,854,664 | A * | 12/1974 | Hunter | 239/206 |
| 4,353,506 | A * | 10/1982 | Hayes | 239/206 |
| 4,625,914 | A * | 12/1986 | Sexton et al. | 239/206 |
| 4,637,548 | A * | 1/1987 | Ray et al. | 239/201 |
| 4,787,558 | A * | 11/1988 | Sexton et al. | 239/205 |
| 4,913,351 | A * | 4/1990 | Costa | 239/74 |
| 4,913,352 | A | 4/1990 | Witty et al. | 239/104 |
| 5,240,182 | A * | 8/1993 | Lemme | 239/205 |
| 5,711,486 | A * | 1/1998 | Clark et al. | 239/205 |
| 5,779,148 | A * | 7/1998 | Saarem et al. | 239/104 |
| 5,871,156 | A * | 2/1999 | Lawson | 239/201 |
| 6,186,413 | B1 * | 2/2001 | Lawson | 239/205 |
| 6,227,455 | B1 * | 5/2001 | Scott et al. | 239/1 |
| 6,478,237 | B2 * | 11/2002 | Kearby et al. | 239/232 |
| 6,491,235 | B1 * | 12/2002 | Scott et al. | 239/206 |
| 6,834,816 | B2 | 12/2004 | Kah, Jr. | 239/451 |
| 6,997,393 | B1 * | 2/2006 | Angold et al. | 239/205 |
| 7,600,699 | B2 * | 10/2009 | Kah et al. | 239/203 |
| 8,991,730 | B2 * | 3/2015 | Kah et al. | 239/581.1 |
| 2003/0075620 | A1 * | 4/2003 | Kah, Jr. | 239/553 |
| 2004/0195358 | A1 * | 10/2004 | Santiago et al. | 239/200 |

(Continued)

*Primary Examiner* — Arthur O Hall
*Assistant Examiner* — Steven M Cernoch
(74) *Attorney, Agent, or Firm* — Ostrolenk Faber LLP

(57) ABSTRACT

An irrigation sprinkler nozzle assembly including a pressure regulator having a low friction seal for a riser assembly in which the regulator is installed. The pressure regulator includes a movable portion, a fixed portion located upstream of the movable portion, and connectable to a water inlet, and a biasing member such as a spring which applies a force to the movable portion according to a pressure differential between the water inlet pressure and a reference pressure. The fixed and movable portions move relative to each other according to the force provided by the biasing member to provide a variable flow restriction which maintains the desired pressure. The low friction seal is a diaphragm connected at one end to the movable member and anchorable at another end in the nozzle head.

12 Claims, 4 Drawing Sheets

(56) References Cited

U.S. PATENT DOCUMENTS

2005/0045737 A1* 3/2005 Clark et al. ..... 239/73

* cited by examiner

PRESSURE REGULATING NOZZLE ASSEMBLY

CROSS-REFERENCE TO RELATED APPLICATIONS

This application is based on and claims priority to U.S. Provisional Application 60/683,548, filed May 20, 2005, the entire disclosure of which is incorporated herein by reference.

BACKGROUND OF THE INVENTION

Several of the major manufacturers of irrigation equipment, have spray heads with a pressure regulating valve incorporated into the sprinkler riser assembly. One such device is shown in U.S. Pat. No. 4,913,352. These devices all have "O" ring regulating piston seals which engage the inner surface of the riser tube to prevent leakage. Especially after they have been exposed to dirt and minerals in the water during use the friction between the seal and the tube can become quite high. To assure proper retraction of the piston, large powerful springs, e.g., exerting a force of 5-6 pounds, are required. To accommodate the large spring requires a large sprinkler head. As a consequence, there are no available pressure regulating nozzle assemblies that can be attached to the top of existing sprinkler assemblies. A need thus exists for a more compact pressure regulating nozzle assembly that can be easily attached to existing installed sprinkler risers to replace their existing non-pressure regulating nozzle assemblies.

SUMMARY OF THE INVENTION

The present invention seeks to satisfy the need for a compact simple pressure regulating valve by using a stepped diaphragm valve as disclosed in U.S. patent application Ser. No. 10/118,490, the disclosure of which is incorporated herein by reference as if fully disclosed. The result is a reliable configuration that is small enough to be incorporated into the spray nozzle and filter assembly of a spray type sprinkler nozzle assembly to provide uniform performance over a wide-range of pressure sprinkler inlet pressures.

The new construction would, for example, allow installation of these nozzles into existing spray heads along highways where pressures are sometimes high causing much wasted water over-spray onto the roadways and the danger of accidents. My U.S. Pat. No. 6,834,816 B2 shows an adjustable spray nozzle with an attached filter as a non-limiting example of a construction with which the present invention could be used. The disclosure of the '816 patent is incorporated herein by reference as if fully disclosed.

BRIEF DESCRIPTION OF THE DRAWING(S)

DETAILED DESCRIPTION OF PREFERRED EMBODIMENTS OF THE INVENTION

Figure 1:
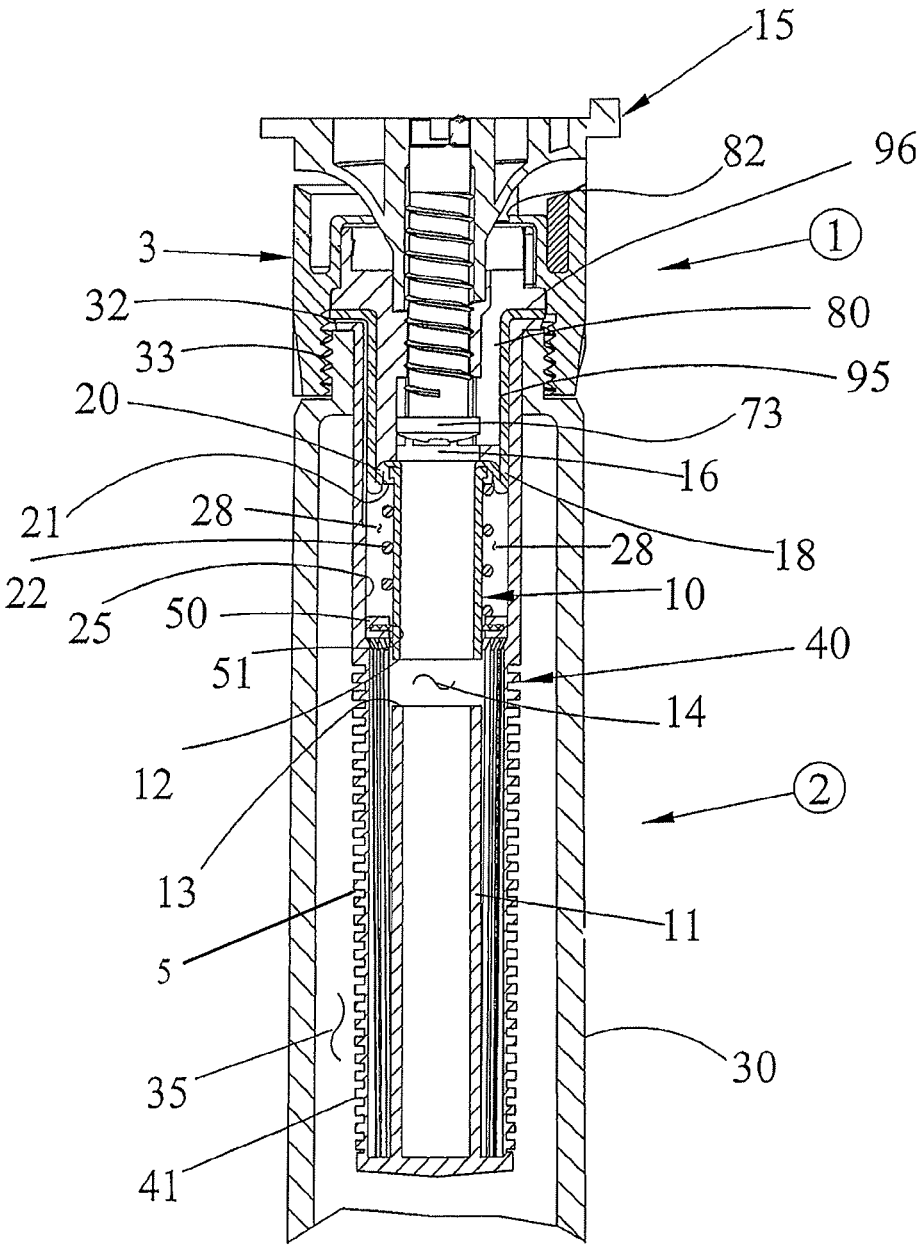
FIG. 1 is a cross-sectional view of an adjustable arc spray nozzle with an attached filter which houses a pressure regulating valve; pressure regulating valve port shown in open position
Figure 1A:
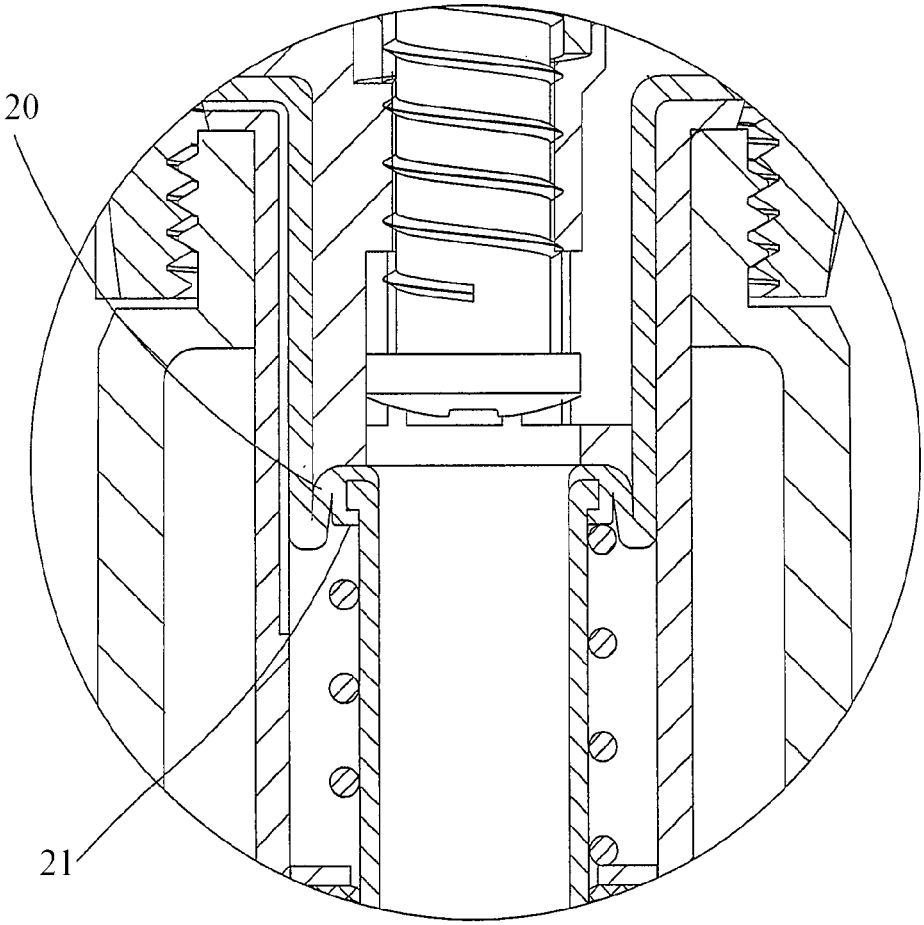
FIG. 1A is a more detailed view of the diaphragm of FIG. 1.

FIG. 1 shows a cross section of an adjustable arc spray nozzle assembly generally designated at 1. This is comprised of a riser 2, a filter assembly 5, a nozzle head 3, and a pressure regulator assembly 4 incorporated into filter assembly 5. These elements are housed in an outer casing (not shown). The riser 2 may be part of an existing installation, with the other identified elements constituting a unit adapted for replacement installation into the existing riser.

The assembly shown is conventional and its construction and operation are well known to those skilled in the art.

It is to be understood that the pressure regulating mechanism is shown in this assembly for exemplary and illustrative purposes, but is adaptable within the scope of the invention for use in other pop-up sprinkler assemblies and other nozzle head constructions as well.

Pressure regulator 4 functions to sense outside pressure and throttles the flow rate to the nozzle to provide a relatively constant pressure for exiting water stream. The nozzle of course can be a fixed spray as well as the adjustable arc spray shown.

Regulator 4 is comprised of an axially movable hollow flow throttling member 10 which acts in conjunction with a hollow tube member 11 extending up from the bottom of the filter to provide a flow restriction between the bottom 12 of member 10 and the top end 13 of member 11.

Figure 2:
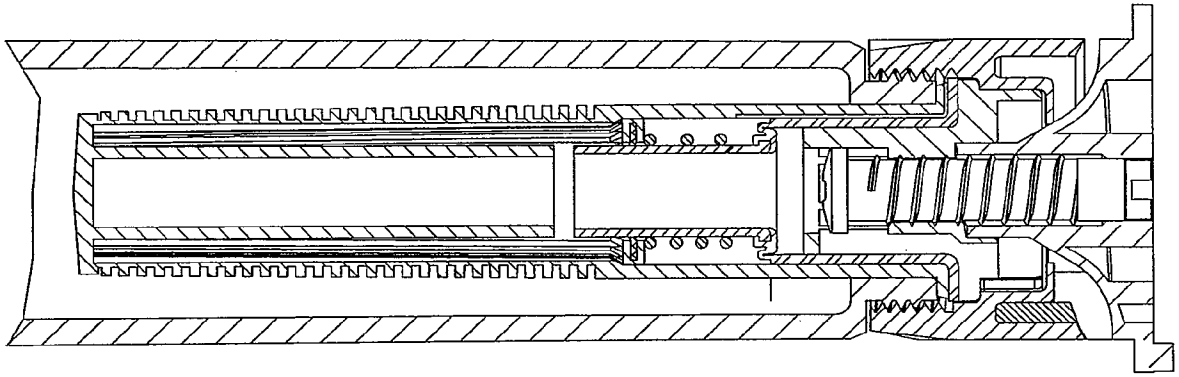
FIG. 2 is the same as FIG. 1 except with the pressure regulating valve shown in an exemplary throttling operating position to provide, i.e. 30 p.s.i. to the spray nozzle of the sprinkler.
Figure 2A:
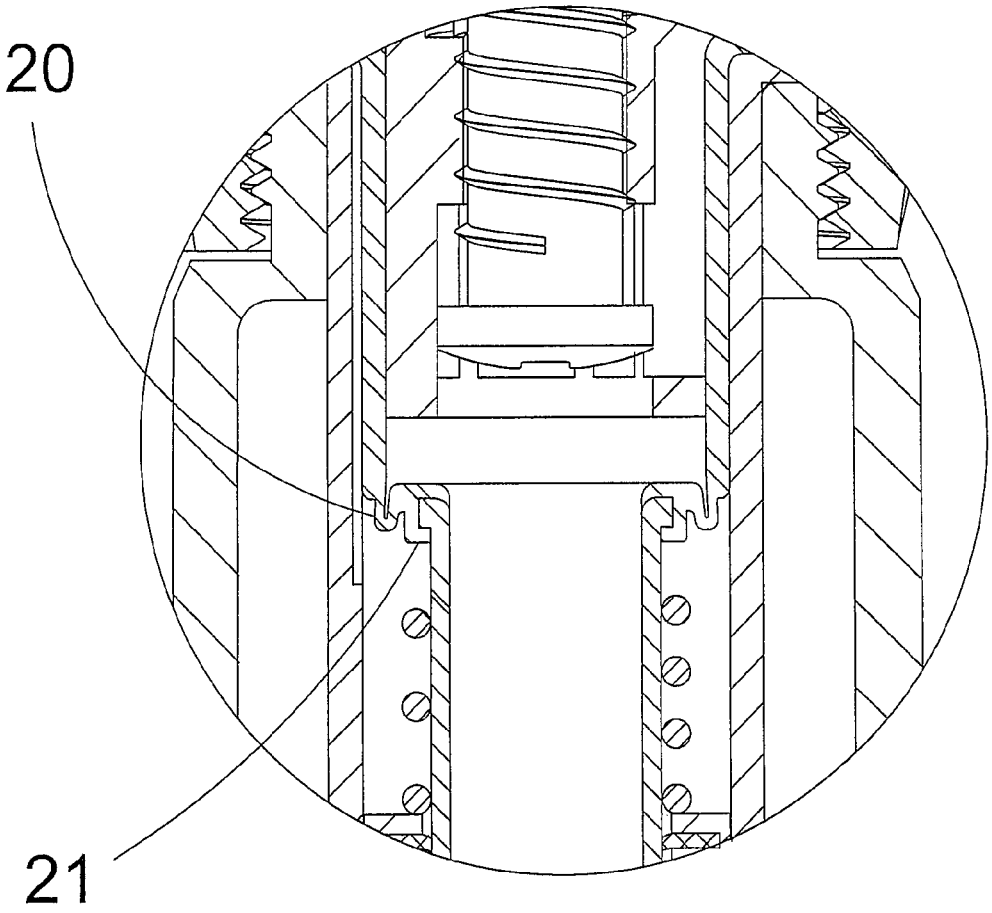
FIG. 2A is a more detailed view of the diaphragm of FIG. 2.

Pressure control flow throttling member 10 is shown in FIG. 2 in a partially throttled position. The flow area around the circumferential bottom edge 12 and the circumferential top edge 13 determine the pressure drop for the flow up the hollow center of member 10 and into cavity 16 located above flow throttling member 10, and which provides communication through circumferentially spaced axial slots 80 forming an outlet flow path to a nozzle outlet 82.

The flow throttling member 10 includes a circumferential rib having a radially extending edge 21.

A stepped diaphragm seal 20 of the type described in my above-identified '490 application seals the upper end of spring cavity 28. Seal 20 is comprised of a first end 18 co-molded, or otherwise formed as an unitary structure with rib edge 21, an axial extending portion 95, and a radially extending upper end 96 suitably anchored in nozzle head 3.

The illustrated diaphragm seal 20 is particularly advantageous in that is impose very low friction on the movement of regulator tube 10, yet provides a reliable seal between outside filter housing wall 25 and the top of member 10. This is because the seal flexes as tube 10 moves upward and carries end 18 upward, shortening portion 95, and forming a generally u-shaped bend at its lower end.

A spring 22 located in a cavity 28 acts against the underside of edge 21 to try to push the flow throttling member 10 up and open flow area 16. Pressure on the upper surface of top edge 21 and the diaphragm seal 20 pushes the throttling member downward against the upward force of spring 22.

The pressure in spring cavity 28 is maintained at atmosphere pressure by a vent slot in the wall 25 of the filter basket which extends to the top of the filter basket where it exits radially outward at 32 to vent to atmospheric pressure through the threads 33. Thus, a true pressure reference is provided internally so that a relatively correct referenced differential pressure between the inside of the spray nozzle and the outside atmospheric discharge area is established for a uniform flow and sprinkler performance over a wide range of possible sprinkler inlet pressures, 30 to 90 p.s.i.

Water at inlet pressure is supplied through a flow path comprising the interior 35 of sprinkler riser tube 2, filter slots 41 of filter basket 40, pressure regulating flow area 14, and the interior of member 10 to area 16 of an adjustable spray nozzle 15 upstream throttling valve area. From here, the water flows past the upstream throttling valve screw head 73 and through slots 80 to the spray nozzle adjustable discharge orifice 82.

The lower end of the atmospheric reference and spring cavity 28 has shaft seal member 50 which has thin lip wiper seal 51 for the hollow shaft of flow throttling member 10 to allow it to move with a minimum of friction.

The spring 22 can be pre-compressed to hold the flow control member up and fully open and not move downward to throttle until the pressure in the nozzle housing cavity 16 has reached a desired level such as 30 p.s.i. The spring should have a low spring rate with sufficient active coils so that the pressure or force required to continue to compress the spring and throttle the flow further is not excessively higher as inlet pressure at 40 and inside the filter at the throttling valve inlet area 14.

Although the present invention has been described in relation to particular embodiments thereof, many other variations and modifications and other uses will become apparent to those skilled in the art. It is intended, therefore, that the present invention be limited not by the specific disclosure herein, but only by the appended claims.

What is claimed is:

1. An irrigation sprinkler nozzle assembly comprising:

a nozzle head including a nozzle spray outlet, and an outlet flow path coupled to the nozzle spray outlet;

a filter attached to the nozzle head, the filter including a top wall with an upper thread formed on the top wall and configured to attach the filter to the nozzle head, the top wall including a reference opening formed therein to provide a reference pressure, the reference opening positioned in the top wall in the area of the upper thread; and a pressure regulator located just upstream of the outlet flow path and entirely within the filter, the pressure regulator including:

a movable portion;

a fixed portion located upstream of the movable portion, and connectable to a water inlet;

a biasing member for applying a force to the movable portion to maintain a desired pressure differential between a nozzle spray outlet pressure and a reference pressure;

the movable portion being movable relative to the fixed portion according to the force provided by the biasing member to provide a variable flow restriction, wherein the nozzle head is connectable to a riser with the filter and pressure regulator protruding into the riser; and a low friction seal positioned between the movable portion and a nozzle assembly housing operable to prevent leakage from upstream of the nozzle spray outlet and the reference pressure area in the nozzle assembly as the movable portion moves relative to the fixed portion.

2. A sprinkler nozzle assembly according to claim 1, wherein the low friction seal is comprised of a diaphragm seal connected at one end to the movable member and anchorable at another end in the nozzle head.

3. A sprinkler nozzle assembly according to claim 1, wherein the biasing member is located in a cavity which provides a pressure reference, and is preset to provide no flow restriction when the nozzle spray outlet pressure is below a desired level.

4. A sprinkler nozzle assembly according to claim 3, where the reference pressure is atmospheric pressure.

5. A sprinkler nozzle assembly according to claim 1, wherein the biasing member is so positioned that it is anchored relative to the fixed portion, and applies a force to the movable portion in a direction to relieve the flow restriction.

6. A sprinkler nozzle assembly according to claim 1, wherein the biasing member is a spring.

7. An irrigation sprinkler nozzle assembly comprising:

a nozzle head including a nozzle spray outlet, an outlet flow path coupled to the nozzle spray outlet and a plurality of lower threads formed on a bottom thereof; and a pressure regulator located upstream of the outlet flow path, the pressure regulator including:

a movable portion;

a fixed portion located upstream of the movable portion, and connectable to a water inlet;

a biasing member for applying a force to the movable portion to maintain a desired pressure differential between a nozzle spray outlet pressure and a reference pressure;

the movable portion being movable relative to the fixed portion according to the force provided by the biasing member to provide a variable flow restriction, and a riser, wherein the nozzle head is connectable to the riser with the pressure regulator extending into the riser;

a low friction seal operable to prevent leakage from the riser as the movable portion moves relative to the fixed portion, and a filter removably mounted in the riser, the movable portion, the fixed portion and the biasing member of the pressure regulator located within the filter, the filter further including a top wall with a plurality of upper threads configured to interact with the lower threads of the nozzle head to attach the filter to the nozzle head, the top wall including a reference opening formed therein to provide the reference pressure, the reference opening positioned in the top wall in the area of the upper threads.

8. A pressure regulating removable nozzle assembly comprising:

a pressure regulating device incorporated into the removable nozzle assembly for installation onto existing sprinklers to replace non-pressure regulating nozzle assemblies, the pressure regulating device including:

a movable member including a first side exposed to pressure in a nozzle housing of the nozzle assembly just upstream of a nozzle outlet to provide a flow of water against a deflector or distributor and a second side exposed to pressure in a reference pressure area in the nozzle housing;

a fixed portion positioned upstream from the movable portion and in fluid communication with a water supply; and a biasing member for applying a force to said movable member to maintain a desired pressure differential between the movable portion and the nozzle outlet by movement of the movable portion against said fixed portion to provide a variable flow throttling area in the nozzle assembly for the flow in the nozzle assembly to the nozzle outlet and a filter configured for attachment to the nozzle assembly, the pressure regulating device housed entirely in the filter, wherein the filter includes:

a top wall section including a plurality of threads configured to attach the filter to the sprinkler assembly, the top wall including a reference opening formed therein to provide the pressure in the reference pressure area of the pressure regulation device, the reference opening positioned in the top wall in the area of the upper threads.

9. The pressure regulating removable nozzle assembly of claim 8, wherein said reference pressure area of the nozzle assembly is vented to the atmosphere through a passage in the nozzle assembly.

10. The pressure regulating removable nozzle assembly of claim 9, further comprising a low friction diaphragm member positioned between the movable member and the fixed member to provide a seal.

11. An irrigation sprinkler nozzle assembly comprising:

a nozzle head including a nozzle spray outlet, and an outlet flow path coupled to the nozzle spray outlet;

a filter assembly connected to the nozzle head and in the flow path, the filter assembly including a top wall section including a plurality of threads configured to attach the filter to the sprinkler assembly, the top wall including a reference opening formed therein to provide atmospheric pressure, the reference opening positioned in the top wall in the area of the upper threads; and a pressure regulator mounted entirely in the filter assembly located upstream of the outlet flow path, the pressure regulator including:

a movable portion;

a fixed portion located upstream of the movable portion, and connectable to a water inlet, the movable portion movable relative to the fixed portion to form a variable upstream flow area;

the movable member having a first side exposed to pressure in the nozzle head and a second side exposed to atmospheric pressure; and a biasing member mounted on the second side of the movable member for applying a force to the movable portion to oppose the pressure in the nozzle head to maintain a desired nozzle head pressure by varying the flow area.

12. An irrigation sprinkler nozzle assembly comprising:

a nozzle head including a nozzle spray outlet, and an outlet flow path coupled to the nozzle spray outlet;

a filter attached to the nozzle head, the filter including a top wall configured to attach the filter to the nozzle head, the top wall including a reference opening formed therein to provide a reference pressure; and a pressure regulator located just upstream of the outlet flow path and entirely within the filter, the pressure regulator including:

a movable portion;

a fixed portion located upstream of the movable portion, and connectable to a water inlet;

a biasing member for applying a force to the movable portion to maintain a desired pressure differential between a nozzle spray outlet pressure and a reference pressure;

the movable portion being movable relative to the fixed portion according to the force provided by the biasing member to provide a variable flow restriction, wherein the nozzle head is connectable to a riser with the filter and pressure regulator protruding into the riser; and a low friction seal positioned between the movable portion and a nozzle assembly housing operable to prevent leakage from upstream of the nozzle spray outlet and the reference pressure area in the nozzle assembly as the movable portion moves relative to the fixed portion.

* * * * *